United States Patent [19]

Sawano

[11] 4,319,874

[45] Mar. 16, 1982

[54] FUSER APPARATUS AND CONTROL THEREFORE

[75] Inventor: Takashi Sawano, Ebina, Japan

[73] Assignee: Xerox Corporation, Stamford, Conn.

[21] Appl. No.: 201,119

[22] Filed: Oct. 28, 1980

[51] Int. Cl.[3] ..... F27B 9/28; F27B 1/26; F27B 9/40

[52] U.S. Cl. ..... 432/60; 432/36; 432/45

[58] Field of Search ..... 432/60, 36, 45

[56] References Cited

U.S. PATENT DOCUMENTS 4,081,213 3/1978 Bar-on et al. ..... 432/60 X 4,232,959 11/1980 Ateya et al. ..... 432/60 X

*Primary Examiner*—John J. Camby

[57] ABSTRACT

Fuser apparatus for fixing toner images to copy substrates by passing the substrates between two pressure engaged fuser members one of which is heated. A control for effecting movement of the members at two different speeds is provided such that the members are moved at the higher speed when a small number of copies are made and at the higher speed and then at the lower speed when a large number of copies are being made. The control includes a temperature sensor for sensing the temperature of the heated member which is used to generate a signal when the temperature of the member falls to a predetermined value, the signal being employed for changing the speed of the members from the higher speed to the lower speed.

13 Claims, 6 Drawing Figures

FUSER APPARATUS AND CONTROL THEREFORE

BACKGROUND OF THE INVENTION

This invention relates to xerographic reproducing apparatus and, in particular, a control device for such an apparatus wherein a drive system for the photosensitive drum and the roll fuser are controlled at a high speed when it is desired to produce a small number of copies from, for example the same original, and at a combination of high and low speeds when a large number of copies are produced.

In a prior art copier having a drive system as shown in FIG. 1, a photosensitive member b and a fixing roll are driven by a drive motor a, so that a toner image formed on the surface of the photosensitive member b is transferred to sheet e fed from a sheet tray d, and the toner image is fixed to the sheet e by the fixing roll c. In a copier of this type, the copying speed has been set to the speed of a system which is the lowest in the follow-up characteristic, in order to adjust a balance in speed among an optical system, a development system and the fixing system. This, however, makes it difficult to increase a copying speed in such a copier, coupled with the limitation on an available power source plug socket. Particularly in a small sized copier, the copying speed is largely dependent on the fixing temperature, which has been an obstacle to increasing the copying speed of the small size copier. For example, when copies are produced under high humidity conditions using a fixing device having a temperature characteristic as shown in FIG. 2 (A—A′ represents a duration of reproduction), the fixing temperature is lowered to $T_2$ shown in FIG. 3 by the time a large number of copies have been produced, resulting in the incomplete fixing of a toner image due to temperature fall-off of the heated fuser roll to an inadequate fusing temperature. Taking into consideration the fact that, in most cases, less than ten copies are produced from the same original, if a drive system is so arranged as to be controlled at a high speed when a small number of copies are produced per unit time, and at a high speed followed by a low speed when a large number of copies are desired, even a small size copier resorting to a power source plug socket in general use may be increased in copying speed.

It is accordingly intended to provide a control device for a copier, wherein a drive system is controlled at a high speed where a small number of copies are produced from a same original and at a high speed followed by a low speed where a large number of copies are desired, whereby increase in a copying speed of a copier employing a power source plug socket in general use is attained.

It is known in the prior art to rotate fuser rolls at different speeds, for example, as described in U.S. Pat. No. 4,081,213. In this patent the speed of the fuser rolls is controlled by the "on" and "Print" buttons of the machine and not by a signal generated by sensing the fuser roll temperature. Moreover, the purpose of the roll rotating at a slower speed is but one of the means by which a soft fuser roll is prevented from being deformed when copies are not being fused. Accordingly, there is only one process speed for the fuser and that is the higher of the two speeds.

BRIEF SUMMARY OF THE INVENTION

The process speed of small copiers utilizing roll fusers is, to a large degree, a function of the fall-off temperature of the heated rolls. As copies are being fused more and more heat is removed from the roll and if a sufficiently large number of copies are to be made the fuser does not have the thermal capacity to keep up with the demand. Heretofore, this problem has been solved by shutting down the machine when the fuser roll falls to a temperature which is inadequate for fusing the toner images. The machine remains inoperative until the fuser roll is again at an adequate fusing temperature.

The present invention solves the problem by providing a control for the fuser which is adapted to rotate the fuser rolls at two different speeds such that the rolls are rotated at the higher speed when a small number of copies are being made and at the higher speed followed by the lower speed when a large number of copies are being made. The control includes a temperature sensor for the heated roll which generates a signal when the roll temperature falls to a predetermined value, the signal being employed for changing the speed of the rolls from the higher speed to the lower speed.

In one embodiment of the invention, the speed change is effected by means of a derailer which shifts a drive chain from a small drive sprocket to a larger one. In another embodiment of the invention, the signal from the temperature sensor is employed in conjunction with a variable frequency oscillator and a drive circuit for running a pulse or synchronous motor.

DETAILED DESCRIPTION OF THE DRAWINGS

DETAILED DESCRIPTION OF THE INVENTION

The present invention will be described in more detail with reference to FIGS. 4 through 9 which disclose preferred embodiments of the invention.

Figure 1:
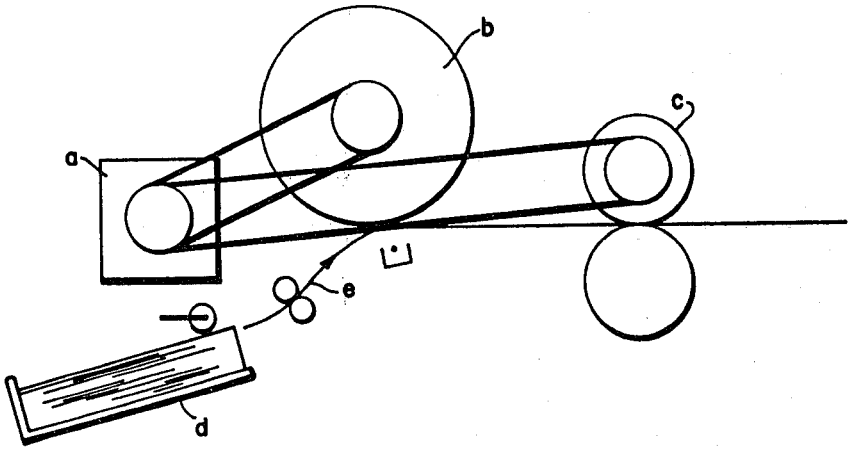
FIG. 1 is a schematic view of a driving system in a prior art copier.
Figure 2:
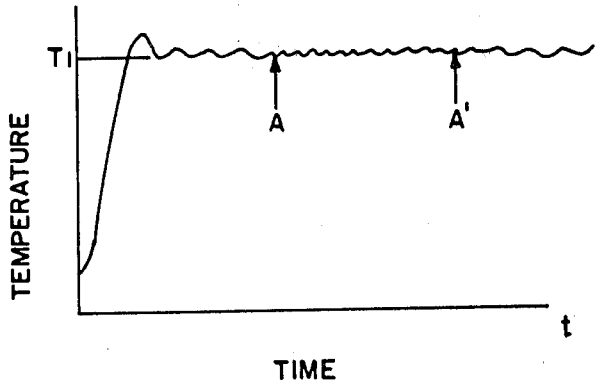
FIGS. 2 and 3 are graphs representing temperature characteristics of the fixing device of FIG. 1, respectively.
Figure 3:
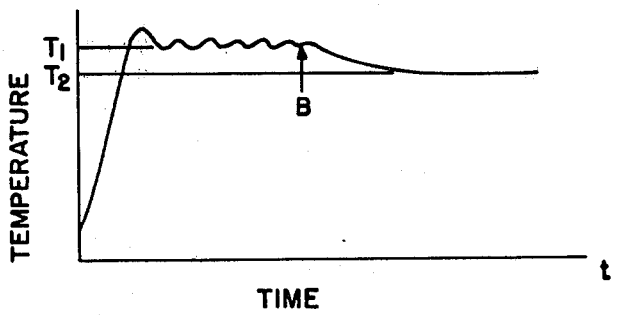
Figure 4:
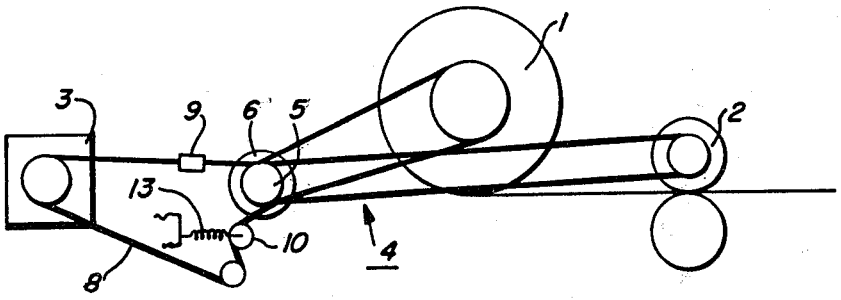
FIG. 4 is a schematic view of a driving system of a preferred embodiment of the present invention.
Figure 5:
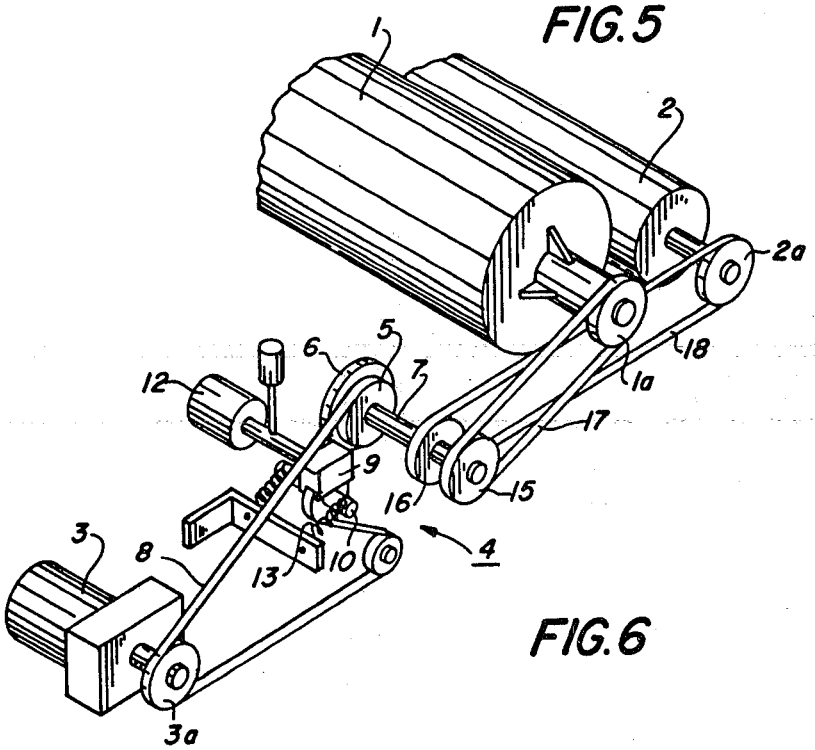
FIG. 5 is a perspective view.
Figure 6:
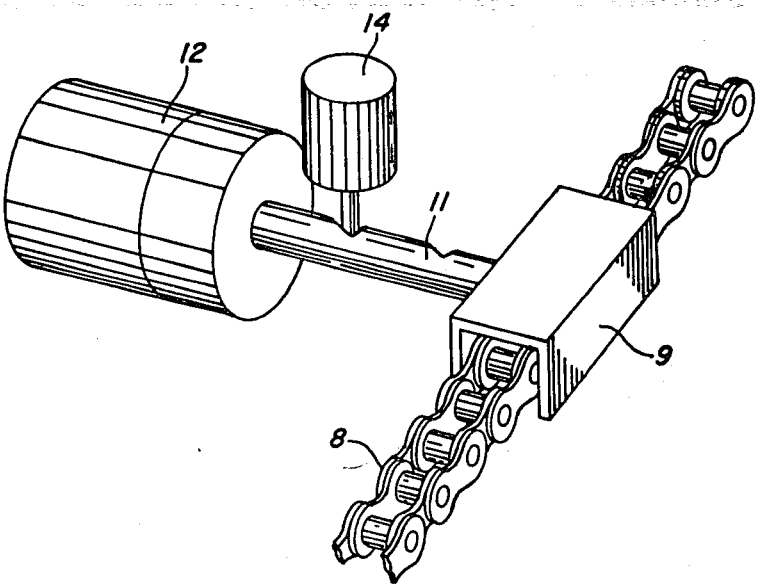
FIG. 6 is an enlarged view of a speed change mechanism.

Shown at 1 in FIGS. 4 and 5 is a photosensitive member of a copier (not shown), and at 2 a fixing roll, both of which are driven at a time by way of a drive system 4 including motor 3. The drive system 4 includes two speedchange sprockets 5 and 6 which are different in number of teeth from each other and mounted on one end of a rotary shaft 7, and an endless chain 8 trained about a sprocket 3*a* of the drive motor 3 and adapted to be selectively trained about either one of the sprockets 5 or 6. Shown at 9 is a derailer for training the endless chain 8 about the sprocket 5 or 6 selectively. The derailer is substantially of an inverted U-shape in cross section and covers a meshing portion of an idler 10 being in mesh with the chain 8. The derailer 9 is connected by way of a connecting rod 11 to a speed change solenoid 12, so that the idler 10 biased in a direction to increase tension of the chain 8 by the force of tension springs 13 may be shifted by the speed change solenoid 12 in parallel to the axis of the rotary shaft 7, whereby the chain 8 may be selectively trained about the sprocket 5 or 6. Shown at 14 is a solenoid for latching the derailer 9 in a position in which it trains the chain 8 about the sprocket 5 or 6.

Sprockets 15 and 16 are mounted on the other end of the rotary shaft 7. An endless chain 17 trained about one sprocket 15 is trained about the sprocket 1*a* of the photosensitive member 1, and the other endless chain 18 trained about the sprocket 16 is trained about a sprocket 2*a* of the fixing roller 2, respectively, so that rotation of the drive motor 3 is transmitted by way of the speed-change sprocket 5 or 6 to the photosensitive member 1 and the fixing roll 2.

The speed change solenoid 12 is controlled in the manner to be described below by a signal from a temperature sensor 19 for detecting a surface temperature at the fixing roll 2.

Figure 9:
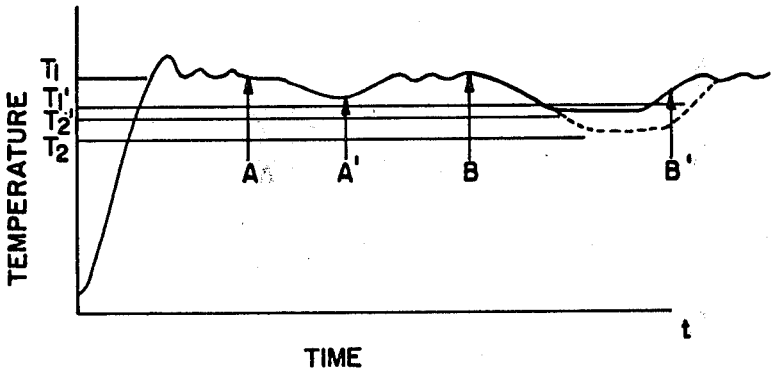

FIG. 9 shows the relationship of temperature versus time in the case where a small number of copies are produced from the same original. When a power source for a copier (not shown) is actuated, the surface temperature at the fixing roll 2 is raised to $T_1$ and maintained thereat. When the copying operation starts, the temperature is lowered degree by degree. The surface temperature of not lower than $T_1'$ is maintained even after termination of the copying operation (for a duration from A to A'), and thereafter returned to $T_1$. For this duration, no control signal is generated from the temperature sensor 19, such that the speed change solenoid 12 remains inoperative, and the derailer 9 is stopped in a position in which same causes the chain 8 to train about the high-speed side sprocket 5. Stated otherwise, for production of a small number of copies from the same original, rotation of the drive motor 3 is transmitted by way of the high-speed side sprocket 5 to the photosensitive member 1 and the fixing roll 2, thereby driving these components at the higher speed, whereby the copying speed is faster than if a much larger number of copies were being made.

When it is desired to produce a large number of copies from the same original, the temperature at the fixing roll 2 is, for example, gradually lowered, eventually to $T_1'$. The temperature sensor 19 detects the temperature $T_1'$ to provide a signal to a comparison circuit 20 as an output. In the comparison circuit 20, a control value is present. The comparison circuit 20 makes a comparison of the input from the temperature sensor 19 with the preset control value, and feeds a control signal to a drive circuit 21 when the temperature is lowered, to $T_1'$ or below. Consequently, current is supplied to the speed change solenoid 12 by the drive circuit 21, whereby the speed change solenoid 12 shifts the derailer 9 to the low-speed side sprocket 6. As a result, the chain 8 is trained about the low-speed sprocket 6, and rotation of the drive motor 3 is transmitted by way of the low-speed side sprocket 6 to the photosensitive member 1 and the fixing roll 2, whereby the copying speed is changed over to the low speed and the surface temperature at the fixing roll 2 is maintained at $T_2'$, which is somewhat lower than $T_1'$, until termination of the copying operation (for a duration from B–B').

Although the speed change temperature $T_1'$ depends on the capacity of the fixing roll 2, the traveling speed of the sheet, and the quality of the sheet, it is recommended that the speed-change temperature be set at a temperature that is by no means raised to above $T_1'$ even by the continuous travel of sheets at a low speed. The control step in the embodiment is shown in the block diagram of FIG. 7.

Figure 7:
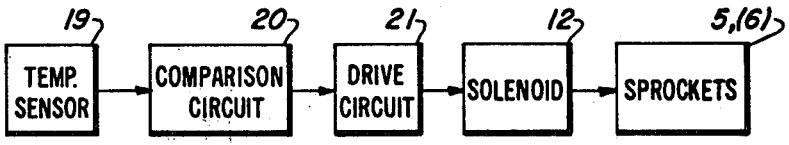
FIG. 7 is a block diagram of control step.
Figure 8:
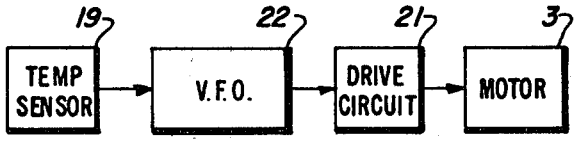
FIG. 8 is a block diagram of a control step according to another embodiment; and, FIG. 9 is a graph representing a temperature characteristic.

FIG. 8 shows a modification of the control step of FIG. 7, wherein a signal from the temperature sensor 19 is fed as an input to a variable frequency oscillator 22, so as to produce a control signal, and the control signal thus obtained is transmitted by way of a drive circuit 21 to the drive motor 3 such as a pulse motor or a synchronous motor, so as to run the drive motor. In this embodiment, the copying speed can be freely varied without using speed-change sprockets 5 and 6 or speed change solenoid 12.

As is apparent from the foregoing, when it is desired to produce a small number of copies from, for example, the same original, stated otherwise, in case the number of copies to be produced per unit time is small, the copying speed is faster, and when a large number of copies are wanted, the copying speed is lowered, such that even a small sized copier having a small heat capacity and operable by using a power source plug socket of the type in general use may be increased in copying speed, and hence reproduction efficiency is promoted.

I claim:

1. Fuser apparatus comprising:

a pair of pressue engaged fuser members;

means for heating at least one of said fuser members;

means of imparting motion to at least one of said fuser members at different velocities, said at least one of said fuser member being initially moved at a first velocity;

means including a temperature sensor for sensing the temperature of said at least one of said fuser members and generating a signal representing a predetermined temperature; and means responsive to said signal for effecting operation of said at least one of said fuser members at a second velocity when said predetermined temperature is sensed.

2. Apparatus according to claim 1 wherein said second velocity is slower than said first velocity.

3. Apparatus according to claim 2 wherein said motion imparting means comprises a pair of chain and sprockets operatively coupling said fuser member and a drive motor and wherein said signal responsive means comprises a solenoid actuated derailer for shifting one of said chains between at least two of said sprockets.

4. Apparatus according to claim 2 wherein said signal responsive means comprises a variable frequency oscillator operatively coupled to a drive motor.

5. Fuser apparatus comprising:

a pair of pressure engaged fuser rolls;

means for heating at least one of said fuser rolls;

means for rotating at least one of said fuser rolls at different angular velocities, said at least one of said fuser rolls being initially rotated at a first angular velocity;

means including a temperature sensor for sensing the temperature of one of said fuser rolls and generating a signal representing a predetermined temperature;

means responsive to said signal for effecting operation of said at least one of said fuser rolls to a second angular velocity when said predetermined temperature is sensed.

6. Apparatus according to claim 5 wherein said second velocity is slower than said first velocity.

7. Apparatus according to claim 6 wherein said motion imparting means comprises a pair of chains and sprockets operatively coupling said fuser member and a drive motor and wherein said signal responsive means comprises a solenoid actuated derailer for shifting one of said chains between at least two of said sprockets.

8. Apparatus according to claim 5 wherein said signal responsive means comprises a variable frequency oscillator operatively coupled to a drive motor.

9. Fuser apparatus comprising:

a pair of pressure engaged fuser members, at least one of said members being heated;

means for imparting motion to at least one of said fuser members at different velocities, said fuser member being initially moved at a first velocity;

means for generating a signal representing a predetermined temperature reached by said heated member;

means responsive to said signal for effecting operation of said at least one of said fuser members at a second velocity when said predetermined temperature is reached, said second velocity being less than said first velocity whereby copies carrying toner images are moved between said fuser members at a slower rate to thereby insure adequate fusing of said toner images to said copies.

10. Apparatus according to claim 9 wherein said signal generating means comprise a temperature sensor for sensing the temperature of said at least one of said members.

11. Apparatus according to claim 10 wherein said fuser members comprise rolls.

12. Apparatus according to claims 9, 10 or 11 wherein said motion imparting means comprises a pair of chains and sprockets operatively coupling said fuser member and a drive motor and wherein said signal responsive means comprises a solenoid actuated derailer for shifting one of said chains between at least two of said sprockets.

13. Apparatus according to claims 9, 10 or 11 wherein said signal responsive means comprises a variable frequency oscillator operatively coupled to a drive motor.

* * * * *

UNITED STATES PATENT AND TRADEMARK OFFICE

CERTIFICATE OF CORRECTION

PATENT NO. : 4,319,874

DATED : March 16, 1982

INVENTOR(S) : Takashi Sawano

It is certified that error appears in the above-identified patent and that said Letters Patent are hereby corrected as shown below:

On The Title Page,

Please change the assignee to:

"Rank Xerox Limited, London, England"

Signed and Sealed this

*Eighth* Day of *June 1982*

[SEAL]

*Attest:*

GERALD J. MOSSINGHOFF

*Attesting Officer*

*Commissioner of Patents and Trademarks*